US005544764A

United States Patent [19]

Cima

[11] Patent Number: 5,544,764

[45] Date of Patent: Aug. 13, 1996

[54] HOLDER FOR PENS, PENCILS, TOOLS, OR THE LIKE

[76] Inventor: Michael D. Cima, 1261 Rodi Rd., Turtle Creek, Pa. 15145

[21] Appl. No.: 263,065

[22] Filed: Jun. 21, 1994

[51] Int. Cl.[6] ..... A47F 7/00

[52] U.S. Cl. ..... 211/60.1; 211/69.5; D19/85

[58] Field of Search ..... 211/70.6, 69, 69.5, 211/60.1, 69.1, 11; D19/75, 77, 81, 84, 85

[56] References Cited

U.S. PATENT DOCUMENTS

| | | | |
|---|---|---|---|
| D. 167,937 | 10/1952 | Friedel | D19/85 |
| D. 290,854 | 7/1987 | Appel | D19/85 |
| D. 304,842 | 11/1989 | Barone et al. | D19/75 |
| D. 305,777 | 1/1990 | Lee | D19/85 |
| D. 332,631 | 1/1993 | Klodt | D19/85 X |
| D. 343,106 | 1/1994 | Eklind et al. | D19/85 X |
| 3,101,840 | 8/1963 | Canning et al. | 211/60.1 X |
| 4,415,092 | 11/1983 | Boyer | 211/69.1 X |
| 5,232,103 | 8/1993 | Koenig et al. | 211/69.5 |
| 5,337,906 | 8/1994 | Digiulio | 211/69.1 X |

*Primary Examiner*—Robert W. Gibson, Jr.
*Attorney, Agent, or Firm*—James Ray & Associates

[57] ABSTRACT

A desk-top, table-top or bench-top holder for pens, pencils, elongated tools and the like, having a body provided with a plurality of parallel, elongated chambers extending downwardly through an upper surface. The body has a generally flat bottom surface transverse to the parallel elongated chambers to serve as a base under-surface upon which the body can rest on a horizontal supporting surface. The body has an upper surface at an inclined angle to the parallel, elongated, chambers so that the chambers are accessible through elongated openings at the upper surface. The body can be produced by any desired technique, such as molding or machining, or can be produced by providing a plurality of tubular elements bonded together in a side-by-side abutting relationship.

15 Claims, 5 Drawing Sheets

HOLDER FOR PENS, PENCILS, TOOLS, OR THE LIKE

FIELD OF THE INVENTION

This invention relates generally to a bench-top, table-top or desk-top holder for pens, pencils, elongated tools or the like such as dental/medical instruments, knitting needles, crocheting hooks, artist paint brushes, or comparable tools used in a trade or hobby; and, more particularly, this invention relates to a novel, one-piece holder for pens, pencils, elongated tools, etc., having a plurality of individual receiving cavities or chambers which is simple and clean in appearance, and has an inclined upper surface which not only makes it easier to see the access openings to the chambers from a seated position, but causes the openings to be somewhat enlarged to thereby facilitate insertion of an pen, pencil, tool, etc. into any of the chambers. In addition, the holder of this invention can very easily and inexpensively be manufactured from elongated, tubular lengths of plastic, glass, metal or the like, as the sole basic components, and can be made in a limitless number of different sizes, forms, configurations and designs without significantly varying the manufacturing technique.

BACKGROUND OF THE INVENTION

Holders for pens, pencils, elongated tools, etc. are well known to be available in a very large number of different styles, forms, sizes, materials, etc. While some are structurally rather complicated and relatively expensive to fabricate, others are structurally simple, inexpensive to fabricate and generally cheap in quality and appearance. While the least expensive may provide only a single opening to a single chamber to receive the pens, pencils, etc, and consist of nothing more that a cup-shaped receptacle, others, slightly more complicated, may provide a grid opening across the top of a single chamber to thereby effect individual openings through which the pens, pencils, etc. are insertable. Still others, typically more complex and costly, are provided with individual compartments so that each pen, pencil, tool, etc. will have its own confined holding area, which makes it easier to select a particular pen, pencil, tool or the like from the plurality that may be contained in the holder. This is particularly ideal for holding rather delicate or sharpened tools such a dental/medical instruments, so that inserting and removing a tool to and from the holder does not cause the tools to be abraded against one another.

SUMMARY OF THE INVENTION

This invention is predicated upon a new and unique holder for pens, pencils, elongated tools, or the like, such as dental/medical instruments, knitting needles, crocheting hooks, artist paint brushes, etc., which provides individual, elongated compartments for holding each individual pen, pencil, tool, etc. to thereby hold them in a completely spaced apart relationship, and which provides an improved view of the upper surface thereof to facilitate insertion and removal of an object to and from the holder without abrading one such object against another. In addition, the unique holder of this invention is of very simple construction, clean in appearance, and is very easily and inexpensively manufactured from elongated, tubular lengths of plastic, glass, metal or the like as the sole basic components, and can be made in a limitless number of different sizes, forms, configurations and designs without significantly varying the manufacturing technique.

In essence, even the simplest holder of this invention would not look out of place on a table-top, on a work bench, or even an executive desk-top, and consists essentially of a single one piece body member having a plurality of parallel, elongated, cylindrical chambers extending downwardly through an upper surface. The body has a generally flat bottom surface transverse to the parallel cylindrical chambers, and is adapted to be a base under-surface upon which the body can rest on a horizontal supporting surface so that the parallel elongated chambers through the tubular elements will extend generally vertically from the horizontal supporting surface. An upper surface is provided, at least a portion of which is at an inclined angle to the parallel, elongated chambers, so that the access to the chambers is not only easier to see from a seated position, but such access openings are defined by elongated openings to the plural chambers, which thereby provides somewhat larger access openings than would otherwise be provided by openings perpendicular to the chambers.

Although the above described holder can be produced by any desired method such as by molding or machining the structure, the body can very easily be produced from a plurality of preformed tubular elements by merely bonding the tubular elements together with an adhesive, or holding them together with a decorative, encircling band. If the tubular elements are made of a fusible material such as plastic, glass, metal or the like, the tubular elements can even be fused together for an interest enhanced appearance. In addition, many other variations can be included to provide a limitless number of possible designs, while the use of certain materials such as plastic tubular elements, will permit considerable variation in the manufacturing techniques, such as permitting the formation of the various surfaces before or after the tubular elements have been joined together.

OBJECTS OF THE INVENTION

The primary object of this invention is to provide a unique and novel, low cost, bench-top, table-top or desk-top holder for pens, pencils, elongated tools such as dental/medical instruments, knitting needles, crocheting hooks, artist paint brushes, or the like, which is of simple construction and clean in appearance.

Another primary object of this invention is to provide a unique and novel, low cost, bench-top, table-top or desk-top holder for pens, pencils, elongated tools such as dental/medical instruments, knitting needles, crocheting hooks, artist paint brushes, or the like, which provides an individual chamber to hold each individual pen, pencil, tool, etc. and has an angled top surface to make the access opening to the individual chambers more easy to see and provides elongated openings to facilitate insertion and removal of elongated objects into such individual chambers.

A further object of this invention is to provide a unique and novel holder for pens, pencils, tools, etc, which can very easily and inexpensively be manufactured from elongated, tubular lengths of plastic, glass, metal or the like as the sole basic component.

An additional object of this invention is to provide a unique and novel, low cost, holder for pens, pencils, tools, etc. which can be made in a limitless number of different sizes, forms, configurations and designs without significantly varying the manufacturing technique.

A still further object of this invention is to provide a unique and novel, low cost, holder for pens, pencils, tools, etc. which has a top surface configuration that will facilitate insertion of the pens, pencils, tools, etc.

These and other objects and advantages of this invention will become apparent from a better understanding of the following detailed description of the invention, particularly when read in conjunction with the attached drawings.

DESCRIPTION OF THE PREFERRED EMBODIMENTS OF THE INVENTION

Figure 1:
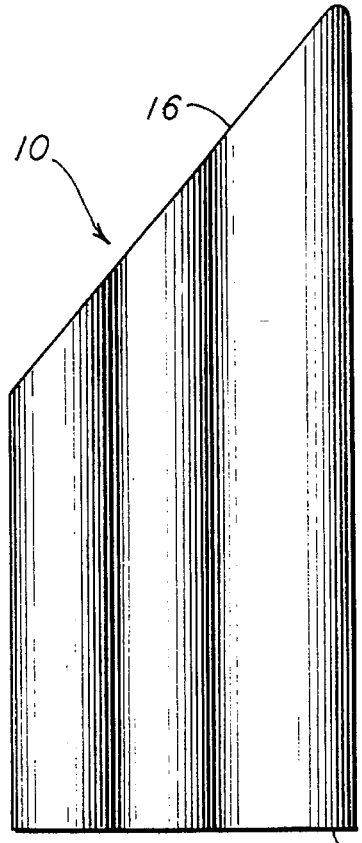
FIG. 1 is a side elevational view of a holder for pens, pencils, tools, etc., in accordance with a presently preferred embodiment of this invention, with parallel, cylindrical chambers therein arranged in a close packed honey-comb arrangement.
Figure 2:
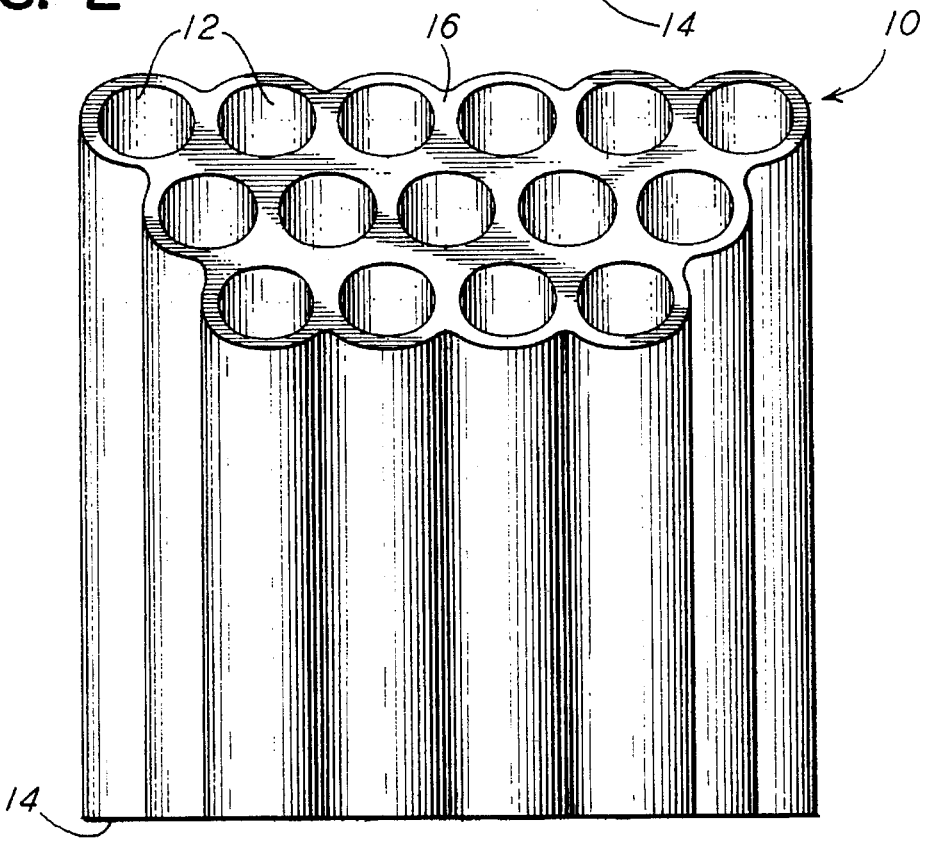
FIG. 2 is a front view of the holder shown in FIG. 1.
Figure 3:
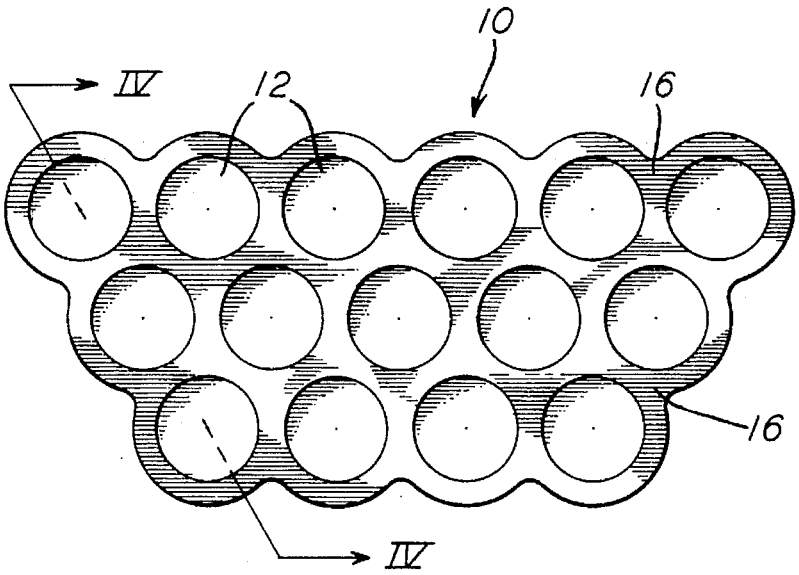
FIG. 3 is a top view of the holder shown in FIGS. 1 and 2.
Figure 4:
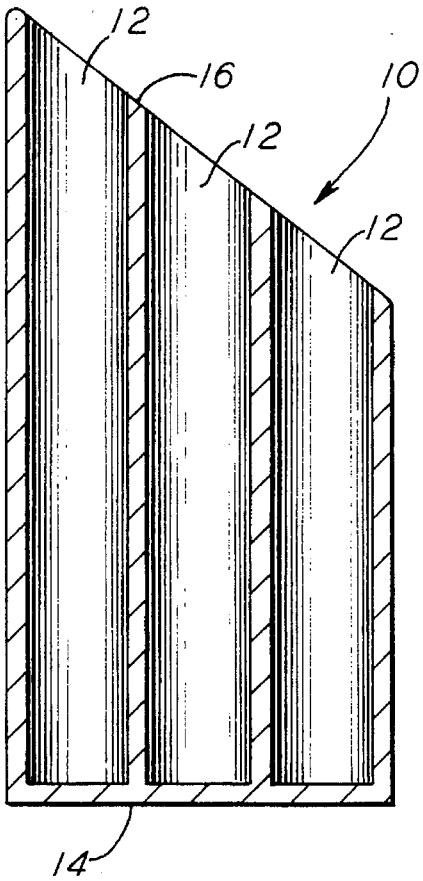
FIG. 4 is a sectional side elevational view of the holder shown in FIGS. 1, 2 and 3 with the section taken an line IV—IV of FIG. 2.

Prior to proceeding with a detailed description of the subject invention, it is noted that for the sake of clarity, identical components which have identical functions have been identified with identical reference numerals throughout the several views of the attached drawings.

Reference to FIGS. 1–4 will illustrate one presently preferred embodiment of the unique pen/pencil/tool holder of this invention, which comprise a single piece body, generally designated 10, which can be formed by any desired means such as molding or machining. The body 10 is provided with a plurality of parallel, cylindrical, elongated chambers 12 extending through an upper surface for purposes of receiving and holding the pens, pencils, tools, etc. The body 10 has a generally flat bottom surface 14 transverse to the parallel, elongated chambers 12, and is adapted to serve as a base under-surface upon which the body 10 can rest on a horizontal supporting surface, such as a desk, table, work bench or the like (not shown), so that the parallel, elongated chambers 12 will extend generally vertically from the horizontal supporting surface. An upper surface 16 is provided on body 10, at least a portion of which, is at an inclined angle to the parallel, elongated chambers 12, so that the accesses to the parallel, elongated, cylindrical chambers 12, are defined by elliptical upper openings to the cylindrical chambers 12. While upper surface 16 could be horizontal and parallel to the bottom surface 14 if so desired, an angled upper surface as described provides the advantage that the opening to the chambers 12 will be easier to see from a normal seated position adjacent to the holder, and the angled surface will cause the openings to the chambers 12 to be elliptical in shape, thereby facilitating the ability to insert a pen/pencil/tool into each chamber 12. For optimum effect, the angle of upper surface 16 should preferably be from 30° to 60° to such parallel elongated chambers 12. While the bottom surface 14 is shown to be perpendicular to the parallel chambers 12, the bottom surface 14 can also be at an angle other than perpendicular to the chambers 12, so that chambers 12 will extend generally, vertically upward at an angle other than a true vertical angle. This too, may serve to make the top surface 16 easier to see from a seated position adjacent to the holder to facilitate insertion of objects into the chambers 12. If the chambers 12 are in fact inclined from a true vertical orientation, any tool or object therein will held at an inclined angle to the user, thereby rendering the tool or object easier to grasp.

The holder as described above, and as illustrated in FIGS. 1–4, can be formed by molding, injection molding or the like using a plastic, glass or a metal, or it can be machined from a block of plastic or metal.

Figure 9:
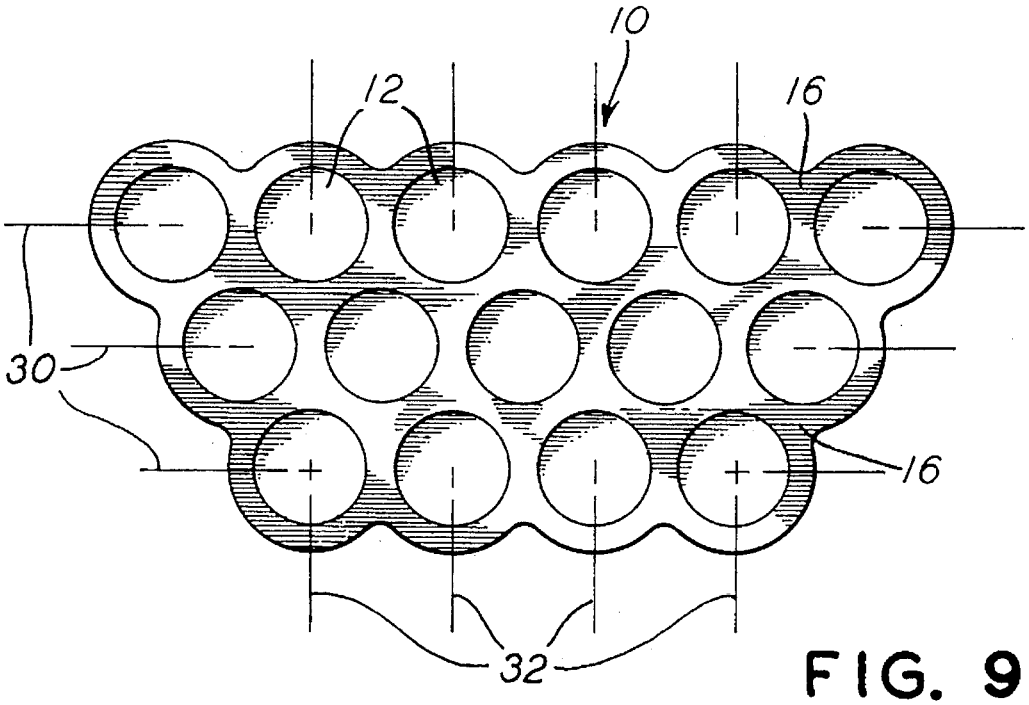
FIG. 9 is a top view of the presently preferred embodiment of the holder illustrated in FIGS. 1 through 4 which shows the substantially parallel relationship of the elongated chambers.

Illustrated in FIG. 9 is a plane 30 that dissects the elongated chambers 12 along a longitudinal axis of each elongated chamber 12 disposed in the same row of each of the three rows of such elongated chambers 12 shown. Each plane 30 is disposed substantially parallel to each other. Further illustrated in FIG. 9 are substantially parallel planes 32 that are disposed transverse to the parallel planes 30 that dissect the elongated chambers 12 along a longitudinal axis of each elongated chamber 12. Such parallel planes 32 bisect alternate rows of such elongated chambers 12. It will be noted on FIG. 9 that parallel planes 32 bisect only the longitudinal axis of the outside rows of elongated chambers 12 and do not touch the longitudinal axis of the middle row of elongated chambers 12.

Figure 5:
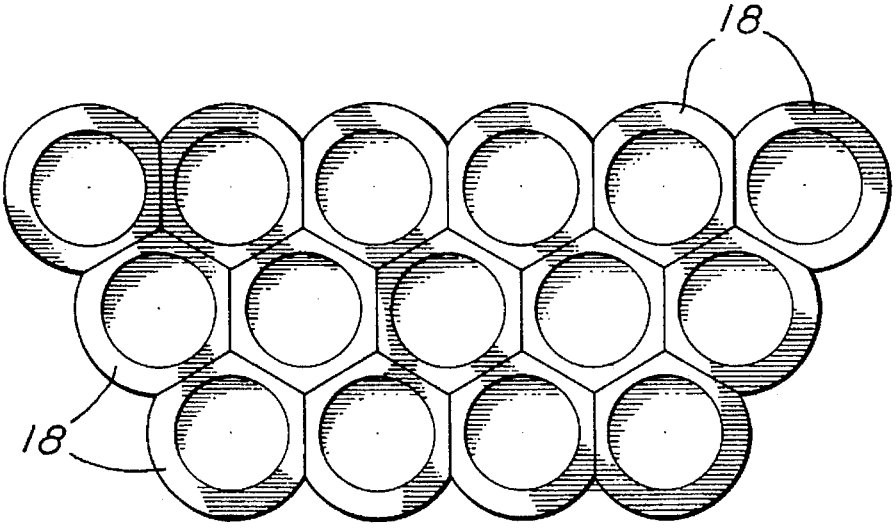
FIG. 5 is a top plan view of another embodiment of the holder of this invention which has a shape and configuration identical to that shown in FIGS. 1–4, and differs only in that the holder is fabricated from a plurality of elongated tubular elements.

Another rather low cost method is to produce the holder from a plurality of tubular elements. Reference to FIG. 5 will illustrate another embodiment of the holder of this invention which is essentially identical to the embodiment shown in FIGS. 1–4, except that the holder is fabricated from a plurality of elongated tubular elements 18, joined together in a side-by-side abutting relationship, such that the cylindrical openings at the axes of tubular elements 18 form and become the cylindrical chambers 12.

Figure 6:
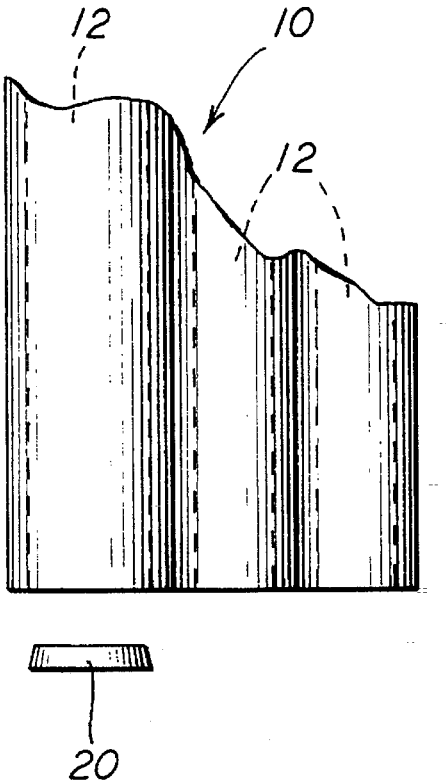
FIG. 6 is partial side view of the holder shown in FIG. 5 illustrating the insertion of a plug member to close the bottom of an elongated chamber within a tubular element.
Figure 7:
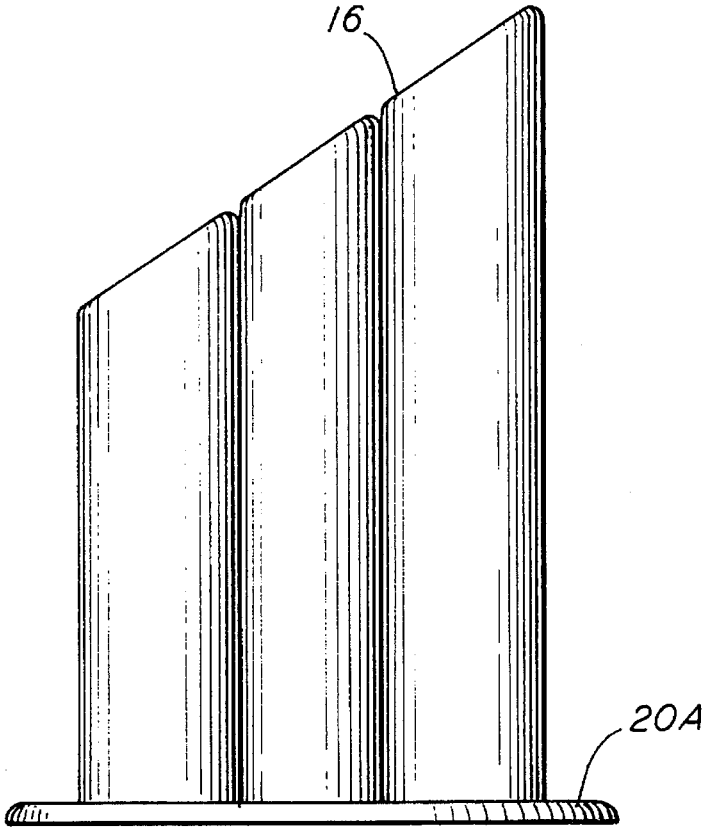
FIG. 7 is full side view of the holder shown in FIG. 5 illustrating the use of a base member to close the bottoms of the elongated chambers within the tubular elements.

Although it is not absolutely essential, it is preferable to provide some means for closing the bottom ends of the plurality of parallel elongated chambers 12 when the holder is fabricated from a plurality of tubular elements 18. This can be done in any of a number of different ways. For example as shown in FIG. 6, a plurality of individual cylindrical plug members 20, having a diameter generally equal to that of the chambers 12, can be inserted into each chamber 12 by any technique that will secure the plug member 20 in place once inserted, such as the use of an adhesive. As an alternative, the plug members 20, can be made to have slightly tapered side surfaces so that they can be wedged into the bottom openings of the chambers 12 and held in place by the frictional forces created. The use of such individual plug members 20 will permit a variable placement of such plugs. For example, all such plug members 20 can be positioned in a horizontal plane at or near bottom surface 14, in an equal depth arrangement, or if preferred, can be positioned at different elevations, as may be desired to make each elongated chamber 12 of equal depth. As still another example, and as shown in FIG. 7, a one piece base member 20A can be bonded to the bottom of body 10, so that base member 20A will not only serve to close the bottoms of chambers 12, but will also serve as a flat bottom surface 14A, namely, the base under-surface upon which the body 10 can rest on a horizontal supporting surface (not shown). This base member 20A can be made of the same material as utilized for the tubular elements 18, or made of a rather thin material, such as cardboard, with or without a felt under-surface, to give the entire body 10 an appearance of being a single, one piece structure, or it can be made of a distinct material, such as finished hard wood or marble or other decorative material for the sake of its own pleasing appearance, or to provide a matching characteristic with other desk-top decorations. Again, such a finished base member can be provided with a felt undersurface. Of course, if the body 10 is formed by molding, the closing bottom member can be molded into the structure concurrently with the molding of body 10 as shown in the FIGS. 1–4 embodiment.

In view of the above teaching, it should be apparent that a simple way to manufacture the inventive holder for pens/pencils/tools without the need for costly tools and equipment, is to assemble the structure from a plurality of tubular elements as described. With this technique, the only material needed is the tubular material, from which generally equal lengths of tubular elements 18 are cut, or if preferred, cut in lengths and configurations as desired in the finished holder. Thereafter, the tubular elements 18 are bonded together in a side-by-side abutting relationship, such that each of such tubular elements 18 will have an elongated chamber 12 therethrough in an aligned and parallel relationship, in any preferred physical arrangement utilizing any bonding technique desired. For example, an adhesive can be utilized, or if the tubular elements 18 are made of a fusible material, they can be fused together. After the general form desired is created, and if not already formed when the tubular elements 18 are bonded together, a generally flat bottom surface 14 is formed on the bonded plurality of tubular elements 18; i.e. body 10, transverse to the parallel, elongated chambers 12 such that the parallel chambers 12 extend generally perpendicularly from the flat bottom surface 14, or extend at an angle to the vertical if so desired, as noted above. As also discussed above, this bottom surface 14 can serve as the supporting surface itself, or a flat base member 20A can be secured thereto which will serve as the supporting base. If a separate base member is not utilized, one may wish to close the chambers 12 with plugs 20 as described above.

Thereafter, and if not already formed when the tubular elements 18 are bonded together, the upper surface 16 is formed on the bonded plurality of tubular elements 18; i.e. body 10, at an angle to the parallel, elongated chambers 12 such that the top ends of the tubular elements 18 defining the openings to the chambers 12, are elongated in configuration; i.e., elliptical in shape if chambers 12 are circular in cross-section. If tubular elements 18 are made of plastic or the like, surfaces 14 and 16 will be easy to form by simply cutting and/or grinding the ends of the tubular elements 18 after they are joined together.

While the above description provides all of the essential and preferred elements, it should be readily apparent that the body 10 can be produced in a great number if different arrangements, forms, configurations and designs, and that other elements could be included without departing from the spirit of the invention. As shown in the FIG. 5 embodiment, the tubular elements 18 as illustrated have hexagonal intersecting interfaces so that the tubular elements can be arranged in a close packed, honey-comb configuration. Obviously, the hexagonal configuration could be extended to even the outer surfaces of body 10, or even cylindrical tubular elements could be similarly arranged in a close packed arrangement having intersecting cylindrical surfaces, with the only difference being that small, elongated interstitial void spaces would be present adjacent to each line of contact. Such small interstitial voids could be ignored, filled or sealed depending upon preference. As an alternative, if the tubular elements 18 are made of a thermally deformable and fusible plastic material, they can be compressed together for bonding purposes as well as flattening the intersecting surfaces to eliminate or minimize the interstitial void spaces.

Figure 8:
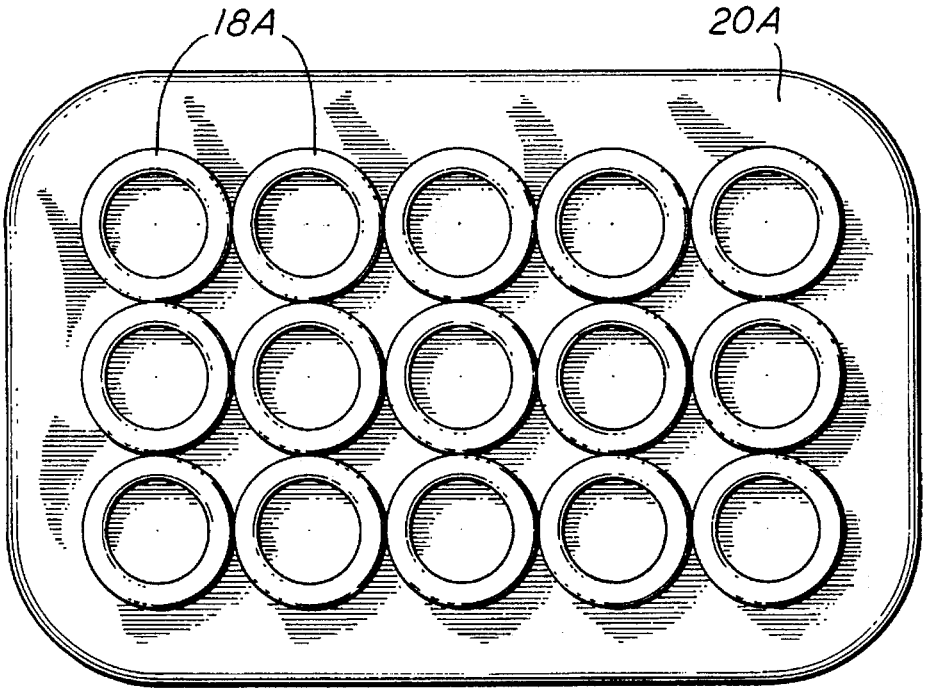
FIG. 8 is a top plan view of a holder in accordance with a another embodiment of this invention showing cylindrical tubular elements arranged in a rectangular grid arrangement.

In addition, arrangements other than close packed could be utilized, as shown for example in FIG. 8, where cylindrical tubes 18A, joined in a rectangular grid arrangement is illustrated. While this arrangement will create rather large interstitial void spaces, such spaces could be utilized for a decorative advantage by filling the spaces with something decorative. As an example, if clear plastic or glass tubular elements 18 are used, the interstitial spaces could be filled colored plastic or glass rods, colored sand, or a colored plastic could be melted and poured into the voids for a striking decorative affect. As an obvious alternative, tubular elements 18 could have a square or rectangular cross-section, which would thereby eliminate the interstitial voids.

As even further options, tubular elements 18 of different sizes, as well as differing cross-sections, could be mixed to create a large variety of interesting geometric arrangements that could add significantly to variety of decorative affect. It should be quite apparent, therefore, that a great number of differing embodiments could be created, limited only by ones imagination.

In view of the above considerations, it is apparent that this invention should be appreciated for having a very wide scope of application, including not only those exemplified above, but many other obvious and not so obvious extensions and variations thereof.

I claim:

1. A holder for pens, pencils, elongated tools and the like, consisting essentially of a body having a plurality of rows of elongated chambers therethrough, each of which are aligned in a side-by-side, parallel relationship, wherein parallel planes that dissect the elongated chambers along a longitudinal axis of each of said elongated chambers disposed in a row of said elongated chambers are bisected by transverse parallel planes at each respective longitudinal axis of alternating parallel rows of said elongated chambers, said body having a generally flat bottom surface transverse to said parallel elongated chambers and adapted to be a base under-surface upon which said body can rest on a horizontal supporting surface such that said parallel elongated chambers will extend generally vertically from such horizontal supporting surface, and an upper surface at least a portion of which is at an inclined angle to said parallel, elongated chambers.

2. A holder for pens, pencils, elongated tools and the like, according to claim 1, in which said parallel, elongated chambers are circular in cross-section, such that each of said chambers having an access through said upper surface at least a portion of which is at an inclined angle to said parallel, elongated chambers, has an elliptical access opening thereto.

3. A holder for pens, pencils, elongated tools and the like according to claim 1, in which at least a portion of said upper surface is a planar surface at an angle of from 30° to 60° to said parallel elongated chambers.

4. A holder for pens, pencils, elongated tools and the like, according to claim 1, in which said body has been formed by molding.

5. A holder for pens, pencils, elongated tools and the like, consisting essentially of a body formed of a plurality of elongated tubular elements joined together in a side-by-side abutting relationship, each of said tubular elements having an elongated chamber therethrough, each of which are aligned in a parallel relationship, wherein parallel planes that dissect the elongated chambers along a longitudinal axis of each of said elongated chambers disposed in a row of said elongated chambers are bisected by transverse parallel planes at each respective longitudinal axis of alternating parallel rows of said elongated chambers, said body having a generally flat bottom surface transverse to said parallel elongated chambers and adapted to be a base under-surface upon which said body can rest on a horizontal supporting surface such that said parallel elongated chambers will extend generally vertically from such horizontal supporting surface, and an upper surface at least a portion of which is at an inclined angle to said parallel, elongated chambers, such that at least some of said elongated, parallel chambers through said tubular elements are accessible through elongated openings at said upper surface.

6. A holder for pens, pencils, elongated tools and the like, according to claim 5, in which said parallel, elongated chambers are circular in cross-section, such that each of said chambers having an access through said upper surface at least a portion of which is at an inclined angle to said parallel, elongated chambers, has an elliptical access opening thereto.

7. A holder for pens, pencils, elongated tools and the like, according to claim 5, in which a means is provided to close and form a base to each said elongated chambers near said bottom surface.

8. A holder for pens, pencils, elongated tools and the like, according to claim 7, in which said means to close and form a base to each said parallel elongated chambers comprises a cylindrical plug member disposed within each of said elongated chambers.

9. A holder for pens, pencils, elongated tools and the like, according to claim 7, in which said means to close and form a base to each of said elongated chambers comprises a planar base member attached to said body at said bottom surface, said planar base member adapted to be a base under-surface upon which said body can rest on a horizontal supporting surface such that said parallel elongated chambers will extend generally vertically from such planar base member.

10. A holder for pens, pencils, elongated tools and the like, according to claim 5, in which said elongated tubular elements are bonded together with an adhesive.

11. A holder for pens, pencils, elongated tools and the like, according to claim 5, in which said elongated tubular elements are bonded together by fusion.

12. A holder for pens, pencils, elongated tools and the like, according to claim 5, in which said elongated tubular elements are cylindrical in cross-section.

13. A holder for pens, pencils, elongated tools and the like, according to claim 5, in which at least a portion of said elongated tubular elements are hexagonal in cross-section, and are bonded together is a close packed, honey-comb relationship.

14. A holder for pens, pencils, elongated tools and the like, according to claim 5, in which at least a portion of said upper surface is a planar surface at an angle of from 30° to 60° to said parallel elongated chambers.

15. A holder for pens, pencils, elongated tools and the like, according to claim 5, in which said tubular elements are made of a material selected from the group consisting of plastic, glass and metal.

* * * * *

UNITED STATES PATENT AND TRADEMARK OFFICE

CERTIFICATE OF CORRECTION

PATENT NO. : 5,544,764

DATED : August 13, 1996

INVENTOR(S) : Michael D. Cima

It is certified that error appears in the above-indentified patent and that said Letters Patent is hereby corrected as shown below:

Column 3, line 21, delete "an" and insert --on--;

column 3, line 36, delete "a" and insert --an--.

Column 4, line 21, delete "held" and insert --hold--;

column 4, line 49, delete "axes" and insert --axis--.

Column 5, line 8, delete "14A" and insert --14--.

Signed and Sealed this

Fifth Day of November, 1996

Bruce Lehman

*Attest:*

BRUCE LEHMAN

*Attesting Officer*

*Commissioner of Patents and Trademarks*